US005282624A

United States Patent [19]

Viste

[11] Patent Number: 5,282,624

[45] Date of Patent: Feb. 1, 1994

[54] GOLF CLUB HEAD

[75] Inventor: Claude Viste, Gruffy, France

[73] Assignee: Taylor Made Company, Inc., Calif.

[21] Appl. No.: 835,303

[22] Filed: Feb. 14, 1992

Related U.S. Application Data

[63] Continuation of Ser. No. 648,842, Jan. 31, 1991, Pat. No. 5,090,702.

[30] Foreign Application Priority Data

Jan. 31, 1990 [FR] France ..... 90 01377

[51] Int. Cl.[5] ..... A63B 53/04

[52] U.S. Cl. ..... 273/167 H; 273/173

[58] Field of Search ..... 273/173, 175, 167 J, 273/174, 167 H, 78, 77 A

[56] References Cited

U.S. PATENT DOCUMENTS

| | | | |
|---|---|---|---|
| 3,387,844 | 6/1968 | Shippee | 273/78 X |
| 4,618,149 | 10/1986 | Maxel | 273/77 A X |
| 4,754,969 | 7/1988 | Kobayashi | 273/77 A |
| 4,809,977 | 3/1989 | Doran et al. | 273/77 A |
| 5,090,702 | 2/1992 | Viste | 273/175 X |
| 5,094,383 | 3/1992 | Anderson et al. | 164/76.1 X |

*Primary Examiner*—George J. Marlo

*Attorney, Agent, or Firm*—Pollock, Vande Sande & Priddy

[57] ABSTRACT

A golf club head having a metal hollow shell open on a front side and having an annular surface around its front side to which a curved striking plate formed of forged steel is welded.

4 Claims, 2 Drawing Sheets

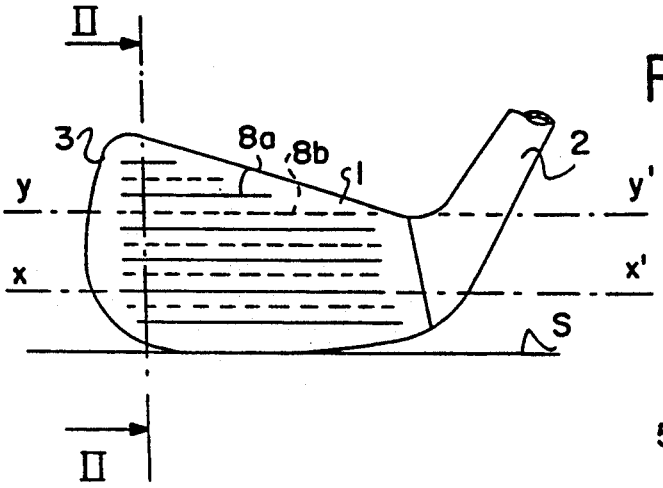
FIG. 1
FIG. 2
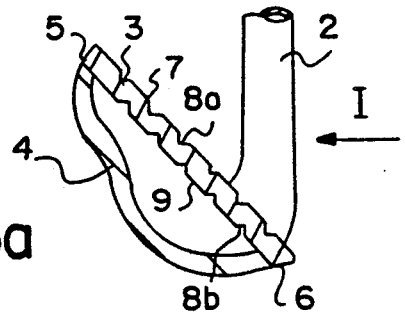
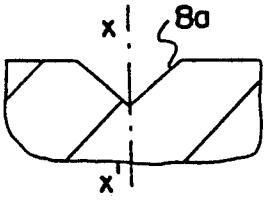
FIG. 3a
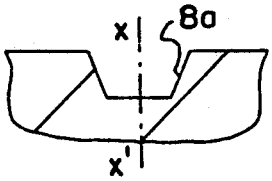
FIG. 3b
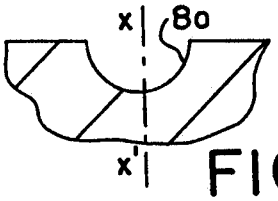
FIG. 3c
FIG. 4a
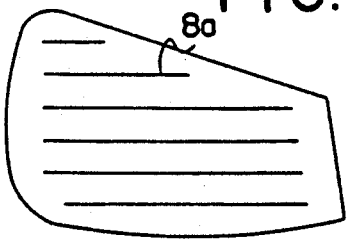
FIG. 4b
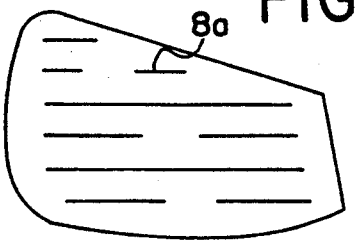

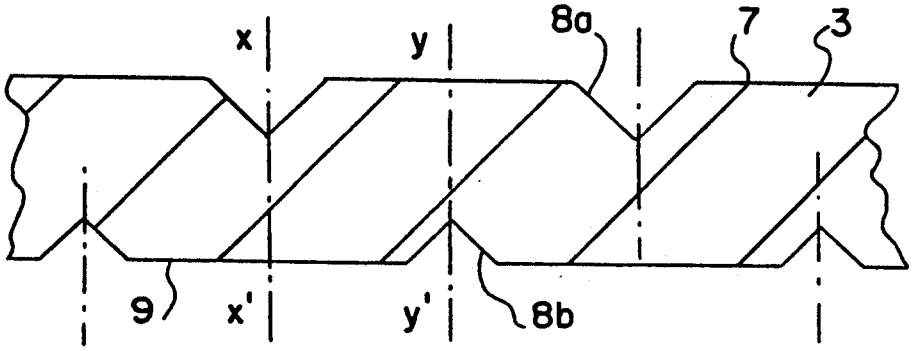
FIG. 5
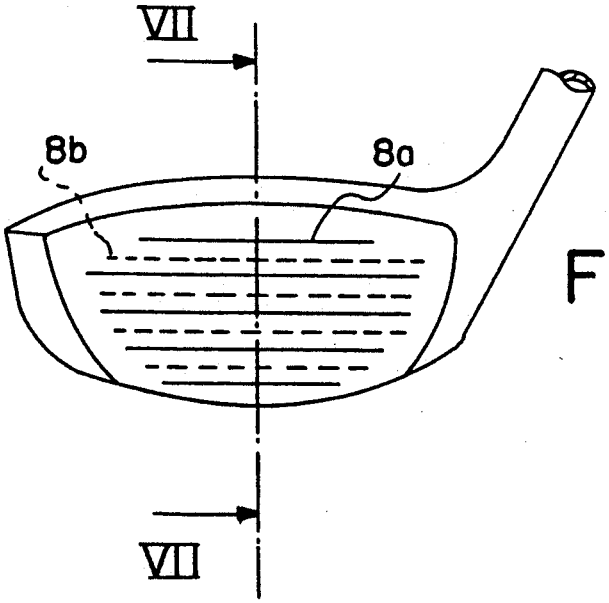
FIG. 6
FIG. 7
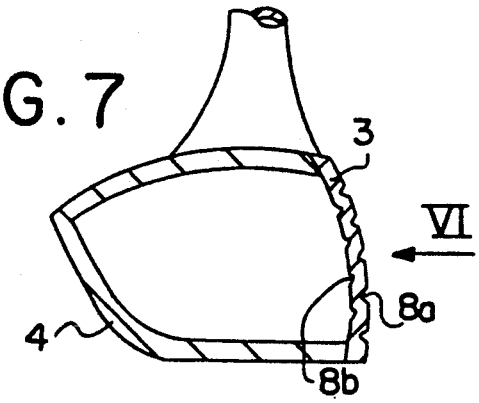

GOLF CLUB HEAD

This is a continuation of application Ser. No. 07/648,842, filed Jan. 13, 1991, now U.S. Pat. No. 5,090,702.

FIELD OF THE INVENTION

This invention relates to a golf club head and more particularly an improvement to its striking face. It also relates to a golf club fitted with the said head.

BACKGROUND OF THE INVENTION

A golf club consists of three parts: a stick, usually called a "shaft", bearing at its upper end a handle called a "grip" and at its lower end a member for striking the ball called a "head". Clubs are classified into three categories designated by the terms "wood", "iron" and, "putter", each of these categories having a head with a specific shape and dimensions.

The invention relates to all types of clubs and in particular woods and irons which have a head whose face striking the ball includes grooves whose function when striking the ball is to help cause the latter to rotate, this rotation having a determining part to play in the accuracy of the shot. This accuracy also depends on the geometry of the striking face and the accuracy of its manufacture, any even minor defect having an effect on the ball's trajectory.

Traditionally a golf club head, and at least its striking face, is made of forged steel. This technique gives the club a good striking quality and a "soft striking feel" to which players are accustomed, but conversely the striking face and the grooves do not have a very satisfactory geometry, which as we have already seen results in irregular shot accuracy.

Another manner of constructing club heads consists of using the molding technique known as the lost-wax technique. This method appreciably improves the geometrical quality of the striking face, thus increasing shot accuracy, but the "feel of the strike" is not the same as that felt from a club whose head has been made by forging. Also, this lost-wax process does not make it possible to obtain a satisfactory groove geometry, and this also has an adverse effect on shot accuracy.

SUMMARY OF THE INVENTION

The object of this invention is to improve the club head by providing a striking face and external grooves of constant quality sufficient to ensure shot accuracy and uniformity while retaining the "soft striking feel" expected by the players. Thus, the golf club head according to the invention comprises a shell and a striking plate of which the face which strikes the balls bears external grooves and which is made of a material which is suitable for forging or stamping, and its inner side includes internal grooves.

Golf club heads having a V-shaped body of carbon fiber reinforced resin material covering an inner body having a triangular metal cross-section are known from U.S. Pat. No. 4,635,941. This body is provided with internal ribs whose sole function is to provide good mechanical attachment between the shell and the body, whose material is of a very different nature.

However, this elastic shell is produced by molding and thus the provision of internal grooves does not in any way improve the finish of the external grooves which have a more precise geometry.

According to the present invention, the club head is manufactured in two parts, namely, (1) a shell which may be hollow, obtained by a process such as lost-wax molding, which gives this part of the head a satisfactory geometrical quality; and (2) the face striking the ball consists of a forged or swaged metal striking plate, preferably of steel, approximately 3 mm thick and fitted to the shell by a technique such as welding, bonding or screwing. On the face which strikes the ball the striking plate has external grooves with concave profiles. In accordance with a preferred embodiment, the longitudinal axes of symmetry of these grooves are parallel to each other and in general parallel to the ground when the club is in a position to strike the ball. Generally, the external grooves of the striking face are continuous and occupy the greater part of the face. However, these external grooves may be discontinuous or have all or some of their axes non-parallel to each other and non-parallel to the ground when the club is in the striking position.

In accordance with the invention, which is designed to provide a geometrically correct striking face, the striking plate includes on its inner side internal grooves consisting of concave profiles whose longitudinal axes of symmetry are preferably parallel to the longitudinal axes of symmetry of the exterior grooves on the striking face. These internal grooves are constructed simultaneously with the external grooves by hot or cold stamping, forging or swaging. The concave profile of these internal grooves is advantageously identical to the concave profile of the external grooves. Thus, if the external grooves have a V-shaped profile, the internal grooves will also have a V-shaped profile. The same applies to a U-shaped profile. Also, in accordance with an advantageous embodiment of the invention, each longitudinal axis of symmetry of the internal grooves is offset by a half pitch with respect to the longitudinal axes of symmetry of the external grooves. However, the arrangement any other combination of shape, profile and/or offset between the longitudinal axes of symmetry of the internal grooves with respect to the external grooves may be used. Likewise, the internal grooves may be continuous or discontinuous.

BRIEF DESCRIPTION OF THE DRAWINGS

Other features and advantages of the invention will be seen in the following description relating to the appended drawings which show several embodiments of the invention by way of example.

FIG. 1 shows a golf club head placed on the ground as seen from direction I in FIG. 2.

FIG. 2 shows the club head in cross-section along line II—II in FIG. 1.

FIGS. 3*a*, 3*b*, 3*c* show three examples of the groove profile in cross-section.

FIGS. 4*a* and 4*b* show the striking face with two forms of the external grooves seen from direction I in FIG. 2.

FIG. 5 shows a cross-sectional detail of the striking plate.

FIG. 6 shows a golf club head of the type called a "wood", seen from direction VI in FIG. 7.

FIG. 7 shows a cross-section through this club head along line VII—VII in FIG. 6.

DESCRIPTION OF PREFERRED EMBODIMENT

FIGS. 1 and 2 illustrate a club head called an "iron". The head consists of a head body 1, a neck or end member 2 and a striking plate 3. The body of the head is constructed in the form of a hollow shell 4 which is open on one side at the front and manufactured by means such as forging, stamping or lost-wax molding. This shell 4 also includes a neck 2 which is intended to receive a shaft, and around its open face it has a substantially flat annular surface 5. The open side of the shell is closed off by the striking plate 3 which bears against the annular surface 5. Striking plate 3 may also be positioned in a rebate provided in annular surface 5. Striking plate 3 is secured to shell 4 by means such as welding, bonding or screwing. This striking plate 3 is of forged steel and has a thickness of approximately 3 mm. Its perimeter 6 has the same profile as annular surface 5 of shell 4 thus providing a club head shape which is without roughness.

Striking plate 3 has external grooves 8*a* on its outer striking face 7 intended to strike the ball and these grooves have a succession of concave profiles, each concave profile having a general plane of symmetry XX', these planes XX' being parallel to each other, as shown in FIG. 1. FIGS. 3*a*, 3*b*, 3*c* show three types of profile for the external grooves: FIG. 3*a* shows a V-shaped profile, FIG. 3*b* shows a U-shaped profile and FIG. 3*c* shows a U-shaped profile with a rounded bottom.

FIGS. 4*a* and 4*b* show two variants of external grooves 8*a* seen from direction I in FIG. 2. FIG. 4*a* shows continuous external grooves, while in FIG. 4*b* they are discontinuous. Of course, other arrangements of the external grooves 8*a*, in particular if the grooves are not parallel with each other or with the ground (S), are within the scope of the invention.

In accordance with the invention striking plate 3 has on its internal surface 9 internal grooves (8*b*) which are a succession of concave profiles, each profile having a general axis of symmetry YY'. These axes YY' are parallel to axes XX' of the external grooves (8*a*) and are advantageously offset by one half pitch with respect to the XX' axes, as shown in FIG. 1. As with external grooves 8*a*, internal grooves 8*b* may be continuous or discontinuous. It is specified that, in principle, the profile of the internal grooves 8*b* is the same as the profile of the external grooves 8*a*. Thus, if the external grooves 8*a* have a V-shaped profile as illustrated in FIG. 3*a*, the internal grooves 8*b* will also have a V-shaped profile. This will also apply to the U-shaped and rounded-shaped profiles shown in FIGS. 3*b* and 3*c*.

The form may, however be quite otherwise, and any combination of shapes of grooves and any offset other than a half pitch between axes XX' and YY' may be used without exceeding the scope of the invention.

In another embodiment, as shown in FIGS. 6 and 7, the invention applies to the head of a "wood" club. In this case, the striking plate 3 is curved after the external 8*a* and internal grooves 8*a*, 8*b* have been constructed, the remainder of the above description being identical.

What is claimed is:

1. A golf club head comprising
(a) a metal head body constituted by hollow shell open on a front side and having an annular surface around said open front side;
(b) a curved striking plate formed of forged steel positioned on said annular surface; and
(c) a weld joint securing said striking plate to said head body.

2. A golf club head according to claim 1, wherein said annular surface comprises a recess in which said plate is positioned.

3. A golf club head according to claim 1, wherein a perimeter of said striking plate has a same profile as said annular surface of said body.

4. A golf club head according to claim 1, wherein said striking plate has a thickness of 3 mm.

* * * * *